United States Patent [19]

Jan

[11] Patent Number: 4,583,536

[45] Date of Patent: Apr. 22, 1986

[54] BREATHING APPARATUS FOR UNDERWATER SWIMMING OR DIVING

[76] Inventor: Rong J. Jan, No. 81-4, Jen-Yi Street, Feng Shan City, Kaohsiung Hsien, Taiwan

[21] Appl. No.: 629,552

[22] Filed: Jul. 10, 1984

[51] Int. Cl.[4] ..... B63C 11/16

[52] U.S. Cl. ..... 128/201.11; 137/202

[58] Field of Search ..... 128/201.11; 137/277, 137/202

[56] References Cited

U.S. PATENT DOCUMENTS

| | | | |
|---|---|---|---|
| 435,990 | 9/1890 | White | 137/202 |
| 3,401,751 | 9/1968 | Loftin | 137/202 |
| 4,269,182 | 5/1981 | Le | 128/201.11 |

*Primary Examiner*—Kyle L. Howell
*Assistant Examiner*—Daniel A. Haneiwich
*Attorney, Agent, or Firm*—Lowe, King, Pice & Becker

[57] ABSTRACT

A breathing apparatus for underwater swimming or diving comprising a ventilating pipe formed with a cylindrical chamber, a buoyancy block disposed into the cylindrical chamber, a plug force-fitted on the top of the cylindrical chamber, a sleeve force-fitted with the center hole of the plug, a rubber tubing connected with the lower end of the sleeve, a movable member having a notch, a cap threadedly engaged with the top of the ventilating pipe, a float body on which is mounted the ventilating pipe, a hose threadedly engaged with the ventilating pipe, and a mouthpiece threadedly engaged with the hose.

1 Claim, 7 Drawing Figures

BREATHING APPARATUS FOR UNDERWATER SWIMMING OR DIVING

BACKGROUND OF THE INVENTION

There are two types of diving suits: the helmet suit, which includes the breathing apparatus and completely encloses the diver keeping warm and dry, and the free-diving or scuba suit which is independent of the breathing apparatus. Scuba is an acronym which stands for 'self-contained underwater breathing apparatus'; the scuba suit is so called because it is used in conjunction with the aqualung. Scuba suits are subdivided in two further classifications: the dry suit, which keeps the diver completely dry; and the wet suit, which incorporates a thin film of water between the diver's body and the suit. However, the above-mentioned breathing apparatuses are inconvenient to use and complex in structure.

It is therefore, an object of the present invention to provide a breathing apparatus which may obviate the above-mentioned drawbacks.

SUMMARY

It is the primary object of the present invention to provide a breathing apparatus which is especially designed for underwater swimming or diving.

It is another object of the present invention to provide a breathing apparatus which may protect the user from breathing in water.

It is still another object of the present invention to provide a breathing apparatus which is simple in construction.

It is still another object of the present invention to provide a breathing apparatus which is easy to assemble.

It is a further object of the present invention to provide a breathing apparatus which is economic to produce..

Other objects and merits and a fuller understanding of the present invention will be obtained by those having ordinary skill in the art when the following detailed description of the best mode contemplated for practicing the invention has been read in conjunction with the accompanying drawings wherein like numerals refer to like or similar parts and in which:

DETAILED DESCRIPTION OF THE PREFERRED EMBODIMENT

Before explaining the present invention in detail, it is to be understood that the invention is not limited in its application to the details of construction and arrangement of parts illustrated in the accompanying drawings, since the invention is capable of other embodiments and of being practiced or carried out in various ways. Also, it is to be understood that the phraseology or terminology, employed herein is for the purpose of description and not of limitation.

Figure 1:
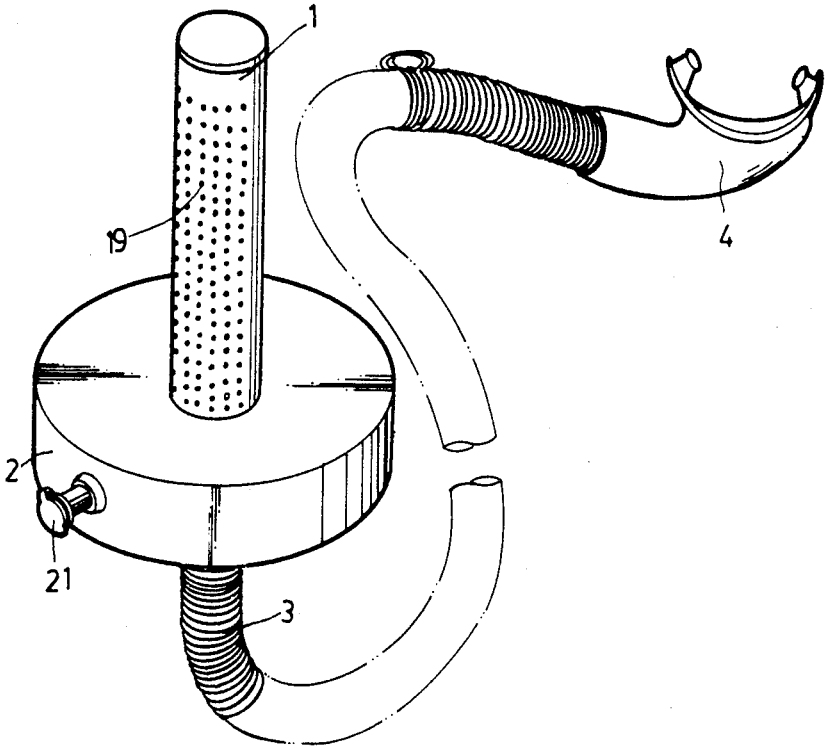
FIG. 1 is a perspective view of a breathing apparatus embodying the present invention.
Figure 2:
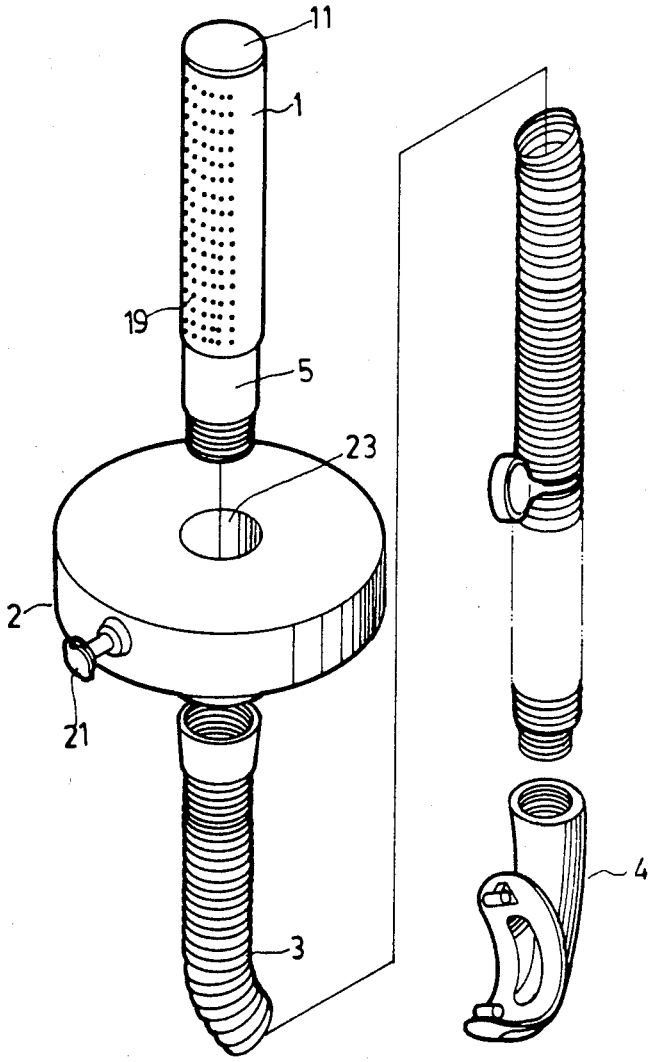
FIG. 2 is an exploded view of the breathing apparatus.

Referring to the drawings and in particular to FIGS. 1 and 2, the breathing apparatus according to the present invention comprises a plastic ventilating pipe (1), a float body (2), a hose (3), and a mouthpiece (4). The plastic ventilating pipe (1) has a reduced portion (5) having screw threads at the lower end. The float body (2) is a plastic bag which may be inflated via an orifice (21). The reduced portion (5) is put into a center hole (23) of the float body (2) and threadedly engaged with the hose (3) which is in turn fitted with the mouthpiece (4).

Figure 3:
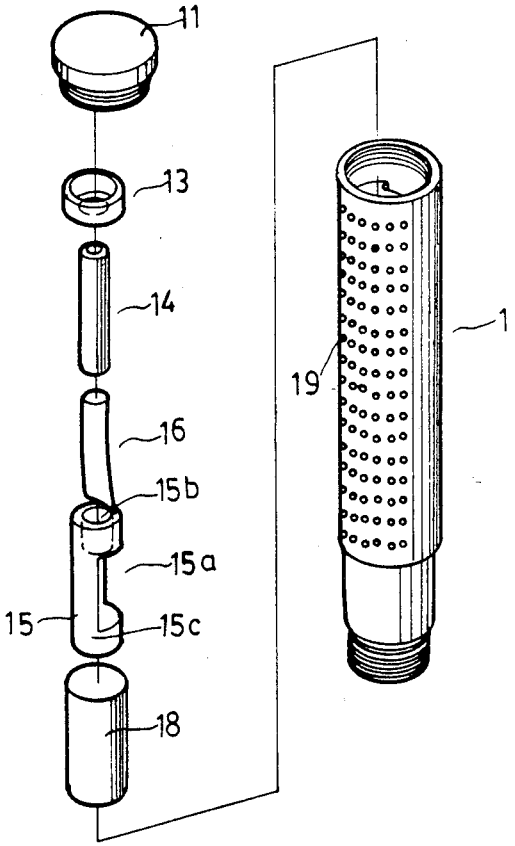
FIG. 3 is an exploded view of the ventilating pipe of the breathing apparatus.
Figure 4:
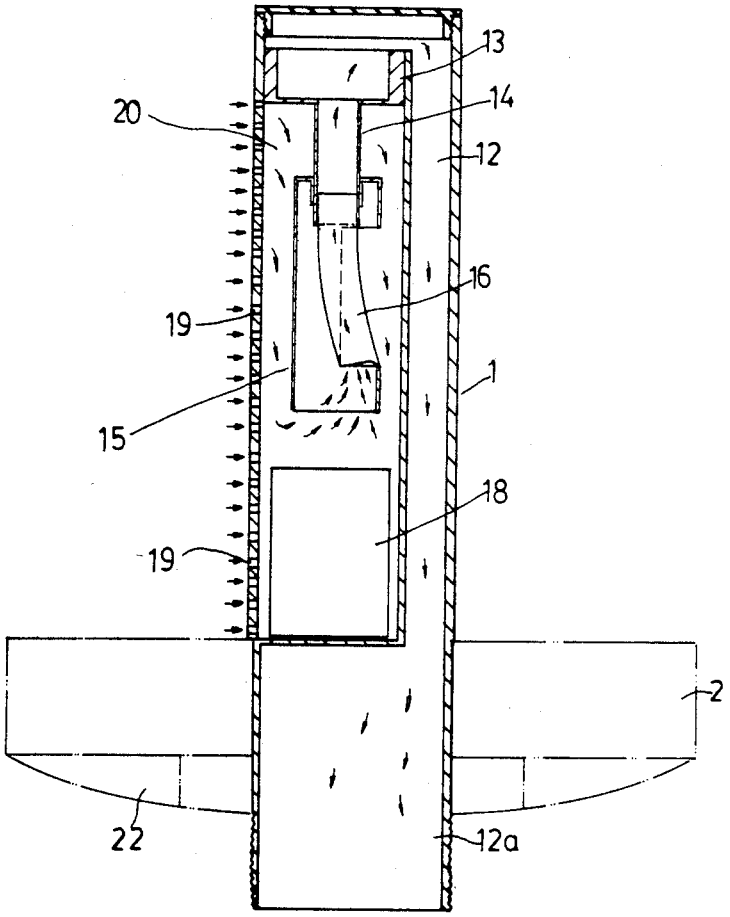
FIG. 4 is a cross-sectional view of the ventilating pipe in normal state.
Figure 6:
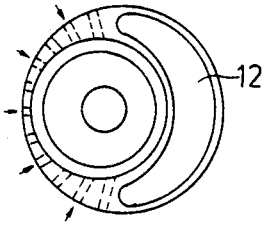
FIG. 6 is a top view of the ventilating pipe.

With reference to FIGS. 3 and 4, the plastic ventilating pipe (1) comes with a cylindrical chamber (20), a meniscus shaped (in cross section) hole (12), and a plurality of holes (19) communicating with the cylindrical chamber (20). A buoyancy block (18) is disposed in the cylindrical chamber (20). A plug (13) is force-fitted on the top of the cylindrical chamber (20). A sleeve (14) is force-fitted in the center of the plug (13) at its upper end and connected with a rubber tubing (16) at its the other end. The rubber tubing (16) is passed into a hole (**15*b*) of a movable member (15). The movable member (15) is formed with a recess (15*a*) having an edge (15*c*) on which is glued the lower end of the rubber tubing (16). The inside diameter of the hole (15*b*) of the movable member (15) is slightly greater than the outside diameters of the rubber tubing (16) and the sleeve (14), so that the movable member (15) can move along the sleeve (15). Further, the top of the plastic ventilating pipe (1) is threadedly engaged with a cap (11**).

In assembly, first inflate the float body (2) through the orifice (21). Then, put the elastic ventilating tube (1) in the center hole (23) of float body (2). Connect the lower part of the plastic ventilation tube (1) with the hose (3). Engage the other end of the hose (3) with the mouthpiece (4).

When in use, the air enters into the plastic ventilating pipe (1) through holes (19), passes upwardly through the movable member (15), the rubber tubing (16), the sleeve (14) and the plug (13), and then passes downwardly through the plastic ventilating pipe (1). The air is subsequently passed to the mouthpiece (4) via the hose (3). Since the float body (2) has a weight (22 ) attached to the bottom thereof, the plastic ventilating pipe (1) may keep upright. The hose (3) is floatable and is filled with air, so that superfluous part of the hose (3) will float on the water surface and user will not be obstructed by the hose (3).

Figure 5:
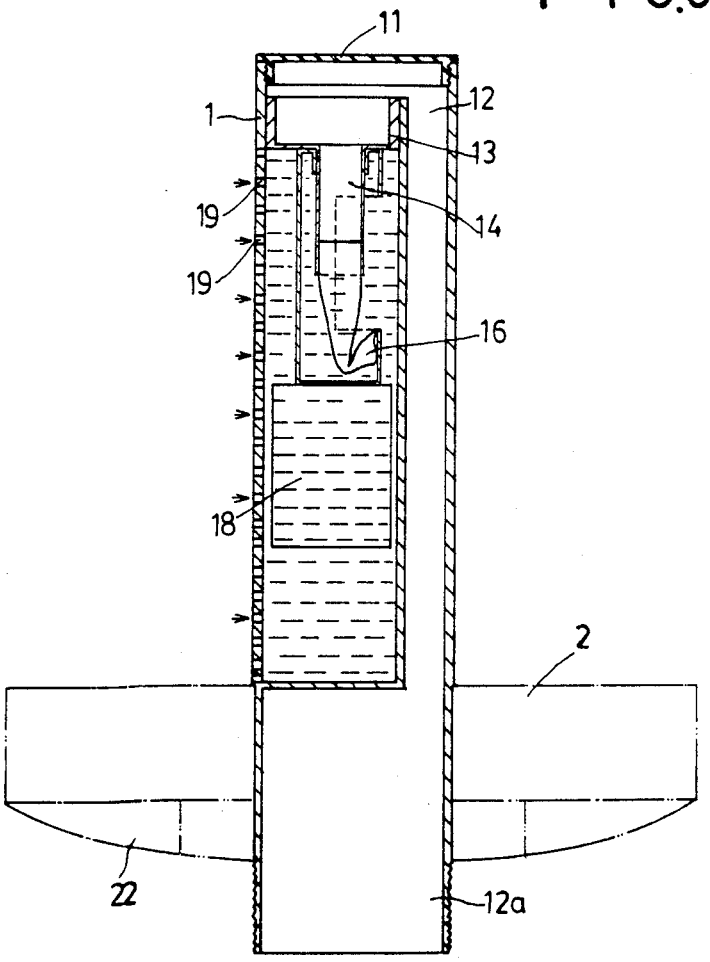
FIG. 5 is a cross-sectional view of the ventilating pipe, showing how to prevent water from flowing into the rubber tubing.
Figure 7:
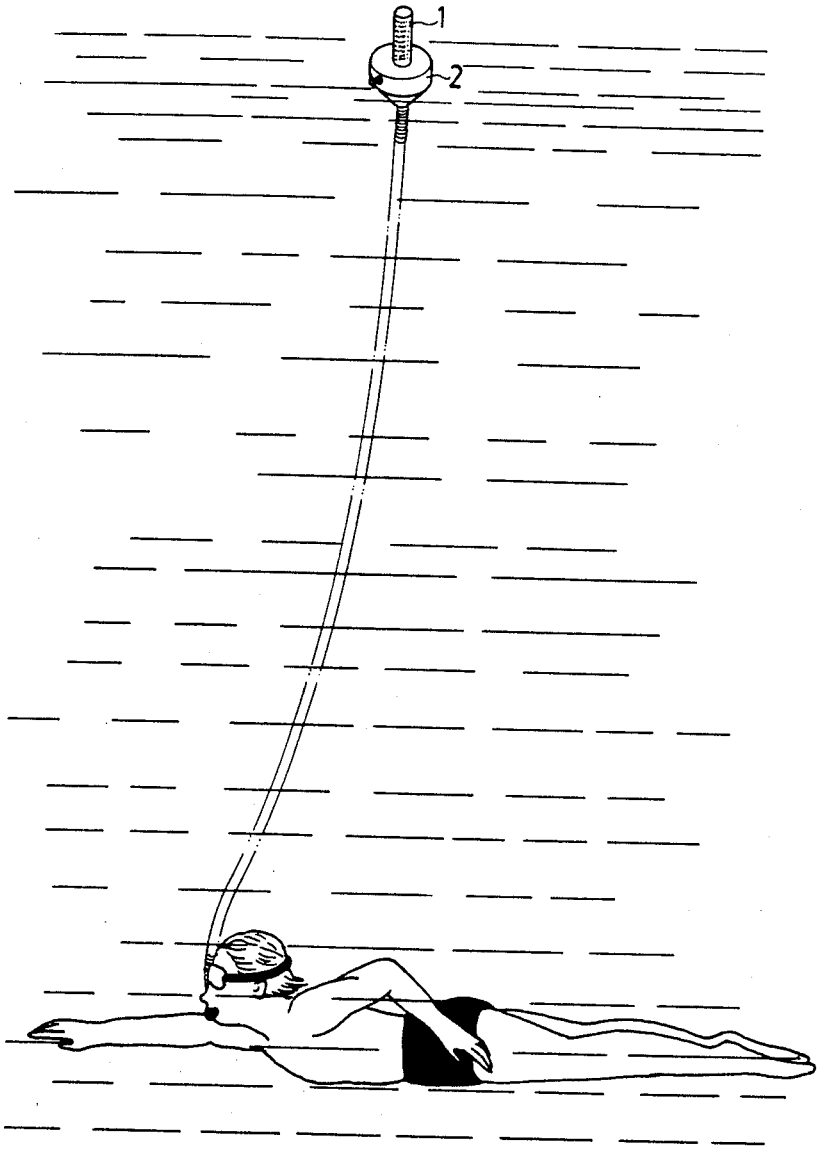
FIG. 7 shows an application of the breathing apparatus.

As water enters into the ventilating pipe (1) from holes (19), the buoyancy block (18) will be moved upward in (20) (as shown in FIG. 5). Consequently, the movable member (15) will be lifted by the buoyancy block (18) along the sleeve (14) until its top surface is in contact with the bottom surface of the plug (13). In the meantime, the rubber tubing (16) will be bent thereby preventing air- and water from passing therethrough. Since the buoyance block (18) cannot be further lifted when contacting bottom of the plug (13), the rubber tubing will not be further bent even if the plastic ventilating pipe (1) is completely immersed in water.

As water flows out of the plastic ventilating pipe (1), the buoyance block (18) will be lowered to the bottom of the hole (20) by gravity. Then, the rubber tubing (16) will recover by its resiliency and air may pass therethrough again.

When not in use, the present invention may be disassembled into a ventilating pipe (1), a float body (2), a hose (3) and a mouthpiece (4), thereby enabling it to be conveniently carried.

Although the present invention has been described with a certain degree of particularity, it is understood that the present disclosure has been made by way of example only and that numerous changes in the detail of construction and the arrangement and combination of parts may be resorted to without departing from the scope and spirit of the invention as hereinafter claimed.

I claim:

1. A breathing apparatus comprising:

a ventilating pipe formed with a cylindrical chamber, an air passage having an upper end communicating with an upper end of said cylindrical chamber, said pipe further including a plurality of holes extending through the ventilating pipe and communicating directly with said cylindrical chamber;

a buoyancy block disposed in said cylindrical chamber;

a plug force-fitted within the upper end of said cylindrical chamber, said plug having a center hole allowing communication between said chamber and passage;

a sleeve force-fitted within the center hole of said plug;

a rubber tubing connected at one end thereof with the lower end of said sleeve;

a movable member slidably fitted at an upper end thereto to said sleeve and at a lower end thereof being connected with the lower end of said rubber tubing, said rubber tubing permitting communication between said ventilation holes and air passage and being bendable to block communication when said movable member moves upwards along said sleeve;

a cap threadedly engaging the top of said ventilating pipe;

a float body on which is mounted said ventilating pipe, said float body being provided with a weight on the bottom thereof;

a hose attached to said ventilating pipe at one end thereof; and a mouthpiece attached to the other end of said hose, air being provided to the mouthpiece through the hose and air passage in the ventilating pipe.

* * * * *